US009452329B2

(12) United States Patent
Lu

(10) Patent No.: US 9,452,329 B2
(45) Date of Patent: Sep. 27, 2016

(54) GRIP FOR SPORTING EQUIPMENT

(71) Applicant: Clive S. Lu, Hicksville, NY (US)

(72) Inventor: Clive S. Lu, Hicksville, NY (US)

( * ) Notice: Subject to any disclaimer, the term of this patent is extended or adjusted under 35 U.S.C. 154(b) by 614 days.

(21) Appl. No.: 13/761,814

(22) Filed: Feb. 7, 2013

(65) Prior Publication Data

US 2015/0202504 A1 Jul. 23, 2015

Related U.S. Application Data

(63) Continuation of application No. 12/410,973, filed on Mar. 25, 2009, now abandoned.

(51) Int. Cl.
*A63B 53/14* (2015.01)
*A63B 49/08* (2015.01)

(52) U.S. Cl.
CPC ..... *A63B 53/14* (2013.01); *A63B 49/08* (2013.01); *A63B 60/06* (2015.10); *A63B 60/08* (2015.10); *A63B 60/10* (2015.10); *A63B 60/14* (2015.10); *A63B 60/48* (2015.10); *A63B 2209/00* (2013.01); *A63B 2209/10* (2013.01); *Y10T 29/49826* (2015.01)

(58) Field of Classification Search
CPC A63B 53/14; A63B 59/0029; A63B 59/003; A63B 53/16; A63B 49/08; A63B 2209/00; A63B 2209/10; A63B 60/48; A63B 60/06; A63B 60/10; A63B 60/08; A63B 60/14; Y10T 29/49826
See application file for complete search history.

(56) References Cited

U.S. PATENT DOCUMENTS 4,133,529 A 1/1979 Gambino
5,398,930 A 3/1995 Gibson
5,460,372 A 10/1995 Cook
5,571,050 A 11/1996 Huang
5,634,859 A 6/1997 Nesbitt
5,671,923 A 9/1997 Huang
5,813,921 A 9/1998 Huang
5,827,129 A 10/1998 Huang
5,890,972 A 4/1999 Huang
5,897,440 A 4/1999 Bae
6,022,278 A 2/2000 Vela
6,656,057 B2 12/2003 Manual et al.
6,709,346 B1 3/2004 Wang
(Continued)

OTHER PUBLICATIONS

Best Grips.com—The Finest in Genuine Leather Sports Grips—Design Your Own Custom Grips; www.bestgrips.com/custom grips; printed Jan. 11, 2011; 2 pages.
(Continued)

*Primary Examiner* — Stephen Blau
(74) *Attorney, Agent, or Firm* — King & Schickli, PLLC

(57) ABSTRACT

A grip for sporting equipment is provided having at least one grip end, a grip end portion extending from each of the at least one grip ends, and a center portion adapted to receive the gripping end of the equipment. Each grip end portion defines a receiver for receiving one or more layers substantially overlaying the center portion. Typically, the grip end portions are fabricated of durable material for protecting the grip ends from damage. The receivers reduce adhesive leakage from between the center portion and the layers and from between the layers. The receivers also protect opposed ends of the layers from damage. The layers may be fabricated of lightweight materials. The thickness of layers formed of lightweight materials may be increased without greatly increasing the grip's weight, thereby increasing the grip's size without greatly increasing its weight.

19 Claims, 13 Drawing Sheets

(56) References Cited

U.S. PATENT DOCUMENTS

| | | | |
|---|---|---|---|
| 6,718,675 | B1 | 4/2004 | Lu |
| 6,843,732 | B1 | 1/2005 | Huang |
| 6,857,971 | B2 | 2/2005 | Huang |
| 6,908,400 | B2 | 6/2005 | Chu |
| 7,025,690 | B2 | 4/2006 | Nam |
| 7,189,168 | B2 | 3/2007 | Lin |
| 7,214,141 | B2 | 5/2007 | Hung |
| 7,232,378 | B2 | 6/2007 | Jaw |
| 7,344,447 | B2 | 3/2008 | Chang |
| 7,377,859 | B2 | 5/2008 | Reardon |
| 7,458,903 | B2 | 12/2008 | Wang et al. |
| 7,461,474 | B1 | 12/2008 | Lu et al. |
| 7,862,445 | B2 | 1/2011 | Huang |
| 7,862,446 | B2 | 1/2011 | Huang |
| 7,980,961 | B2 | 7/2011 | Huang |
| 2002/0107088 | A1 | 8/2002 | Lamkin et al. |
| 2003/0032495 | A1 | 2/2003 | Huang |
| 2003/0207241 | A1 | 11/2003 | Manual et al. |
| 2003/0211900 | A1 | 11/2003 | Novak et al. |
| 2004/0266546 | A1 | 12/2004 | Huang |
| 2006/0009304 | A1* | 1/2006 | Tremulis ..... A63B 53/14 473/300 |
| 2006/0094525 | A1 | 5/2006 | Hung et al. |
| 2006/0116215 | A1 | 6/2006 | Jaw |
| 2006/0199660 | A1 | 9/2006 | Huang |
| 2007/0032309 | A1 | 2/2007 | Chang |
| 2007/0167252 | A1 | 7/2007 | Jaw |
| 2007/0173342 | A1 | 7/2007 | Turnpaugh et al. |
| 2007/0173343 | A1 | 7/2007 | Turnpaugh et al. |
| 2007/0243940 | A1 | 10/2007 | McCree et al. |
| 2008/0176670 | A1 | 7/2008 | Gill et al. |
| 2009/0017935 | A1 | 1/2009 | Wang et al. |
| 2009/0048036 | A1 | 2/2009 | Huang |
| 2011/0053704 | A1 | 3/2011 | Huang |
| 2011/0118043 | A1 | 5/2011 | Lu |

OTHER PUBLICATIONS

International Search Report for International Patent Application No. PCT/US2009/64968 dated Jan. 12, 2010.

Written Opinion for International Patent Application No. PCT/US2009/64968 dated Jan. 12, 2010.

* cited by examiner

GRIP FOR SPORTING EQUIPMENT

This application is a continuation of U.S. patent application Ser. No. 12/410,973 filed on Mar. 25, 2009, the entirety of the disclosure of which is incorporated herein by reference.

FIELD OF THE INVENTION

This invention relates generally to the field of grips for articles of sporting equipment having a gripping end, such as golf clubs and tennis rackets. In particular, the present invention relates to a grip for sporting equipment with grip end portions extending toward the center of the grip for reducing the incidence of leakage of adhesive from areas beneath layers of the grip.

BACKGROUND

The grip provided on most sporting equipment having a gripping end, such as golf clubs, tennis rackets, and the like, provides cushioning and reduces slippage of the user's hands, thereby improving the user's enjoyment of the sport of choice. To provide the desired cushioned, reduced slippage surface for gripping, a grip 100 for such sporting equipment sometimes takes the form of a single, solid piece 120 with a hollow interior 110 that fits over of the gripping end 12, as illustrated in FIG. 1. Other times, a grip 200 for such sporting equipment may comprise a hollow cylinder 210 an overlapping cushioning layer 220, as shown in FIGS. 2*a* and 2*b*. The hollow cylinder 210 has ends 230 and 240 and may be slipped or rolled onto the gripping end 12, and the cushioning layer 220 may be wrapped around the hollow cylinder 210. Also, information regarding the equipment, such as a logo indicating the source of the goods, or a decorative design, may be displayed on the cushioning layer 220 of the grip.

Often, users desire large grips, for example, to accommodate the user's hand size and prevent the overlapping of the user's hands. However, increasing the size of the grip typically greatly increases the weight of the grip as well. Further, such an increase in the weight of the grip often significantly inhibits the user's performance in the sport of choice.

Typically, the cushioning layer of a grip is secured to the hollow cylinder using any of a number of adhesives well known in the art. The installer may apply the adhesive to the hollow cylinder or to the cushioning layer, or the hollow cylinder or the cushioning layer may be purchased with an adhesive substance already on the surface. The installer then simply wraps the cushioning layer around the hollow cylinder and slips the hollow cylinder onto the gripping end.

Use of the adhesive between the hollow cylinder and the cushioning layer provides a strong bond. However, over time and with use, the adhesive tends to leak out from the area between the cylinder and the cushioning layer, staining and damaging the cushioning layer. Such staining and damage of the cushioning layer may impair the grip's ability to provide a cushioned, reduced slippage surface, as well as alter the appearance of any information or decorative designs displayed on the cushioning layer. In addition, grips for sporting equipment often rub against or bump into one another, for example, when carried in the bottom of a golf bag. This contact between the grips further damages the grips and the information and decorative designs displayed on the grips.

Accordingly, there is a need in the art for a means for reducing the incidence of leakage of adhesive from areas beneath layers of a grip of sporting equipment. The means for reducing the incidence of leakage of adhesive should also assist in preventing damage to the grip from contact with other grips. In addition, the means should allow an increase in the size of the grip without resulting in a great increase in the weight of the grip. Also, the means should not interfere with the primary function of providing a secure gripping area for the sporting equipment user or prevent the display of information or decorative designs on the gripping area.

SUMMARY

In accordance with In one aspect, the present invention provides a grip for sporting equipment having a gripping end, comprising at least one grip end, a grip end portion extending from each of the at least one grip ends, and a center portion adapted to receive the gripping end in an interior thereof. Each grip end portion defines a receiver adapted for receiving one or more layers substantially overlaying the center portion. Typically, the grip end portions will be fabricated of a durable material for protecting the at least one grip end from damage and will extend various lengths along the gripping end. Also, the center portion may be a hollow cylinder for receiving the gripping end, and the grip may include an end cap.

It will be appreciated that the grip end portions may be attached to the center portion using any method of attachment known in the art, for example, a friction fit, an adhesive, a combination of adhesive and friction fit, a snap fit structure, and the like. In the alternative, the grip end portions and the center portion may be formed or molded as a single unit using any method of formation or molding known in the art, for example, injection molding, compression molding, extrusion molding, casting, and the like.

Any suitable adhesive as is known in the sporting equipment art may be used to affix the one or more layers to the center portion and to affix the one or more layers to one another. Also, the center portion and the one or more layers may be manufactured of compatible materials such that heat and pressure bond them together.

It will be appreciated that any material having the desired properties, such as where appropriate durability, thickness, strength, cushioning, tackiness, and aesthetically pleasing appearance may be used in fabricating the grip end portions and the receivers. Any number of suitable materials are contemplated, such as rubber, polymers, latex, natural or synthetic leather, closed cell foams, open cell foams, natural material, synthetic material, or any other material currently used in fabricating grips for sports equipment. Any material having the desired properties of strength, durability, thickness, cushioning, and shock absorption required for underlying the layers may be used in fabricating the center portion, such as polymers, rubber, latex, natural or synthetic leather, natural material, synthetic material, or any other material currently used in fabricating grips for sports equipment.

The one or more layers may take any of a variety of forms, such as a hollow cylinder, a planar sheet having two side edges, a top edge, and a bottom edge, or the like. Again, any material having the desired properties, such as where appropriate durability, thickness, strength, cushioning, tackiness, and aesthetically pleasing appearance may be used in fabricating any of the one or more layers, such as polymers, closed cell foams, open cell foams, latex, rubber, natural or synthetic leather, natural material, synthetic material, or any other material currently used in fabricating grips for sports equipment.

In addition, any of the one or more layers may be fabricated of any suitable lightweight material, such as closed cell foams, open cell foams, polymers, or synthetic materials. The thickness of the layers formed of such a lightweight material may be increased without greatly increasing the weight of the grip, thereby increasing the size of the grip without greatly increasing the weight of the grip. Any of the one or more layers also may be fabricated of a suitable substantially transparent material and may protect a design placed on the grip while still allowing visualization of the design.

The receivers may take any form suitable to receive the one or more layers, including but not limited to a flange, rim, projecting edge, lip, slant, groove, bevel, channel, slot, slit, notch, and the like. Advantageously, the receivers assist in preventing the leakage of adhesive from an area between the center portion and the one or more layers as well as from areas between the one or more layers. In addition, the receivers assist in protecting opposed ends of the one or more layers from damage. The receivers and center portion of the grip define a holder having a depth that is greater than a thickness of the center portion side wall.

In another embodiment, the grip may comprise a center portion adapted to receive the gripping end, and a grip end portion adapted for connection to the center portion. The grip end portion defines a receiver adapted to receive one or more layers substantially overlaying the center portion. The receiver and center portion define a holder having a depth that is greater than a thickness of the center portion side wall. Typically, the grip end portion will be fabricated of a durable material for protecting the one or more layers from damage. Also, the grip may include an end cap.

In another aspect, the present invention provides a method of manufacturing a grip for sporting equipment for reducing leakage of an adhesive from the grip, comprising placing at least one layer to substantially overlay a center portion, and attaching a grip end portion to the center portion such that a receiver portion of the grip end portion receives the at least one layer. As described above, the receivers may take any form suitable to receive the one or more layers, and any method of attachment known in the art may be used to attach the grip end portion to the center portion to accomplish the method of the present invention.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the presently preferred embodiment of the invention, an example of which is illustrated in the accompanying drawings.

DETAILED DESCRIPTION

In accordance with the need identified in the foregoing description, the present invention provides a grip 10 for sporting equipment having a gripping end 12 that reduces the incidence of leakage of adhesive from areas beneath layers of the grip 10.

Figure 1:
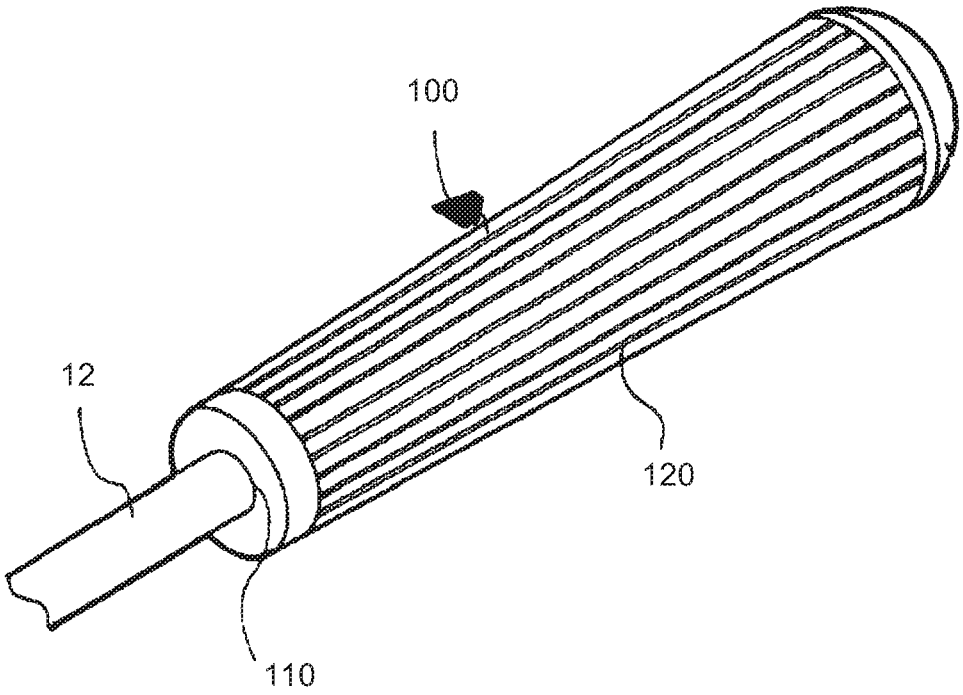
Figure 1 (Prior Art)
FIG. 1 is a perspective view of a prior art grip having a single, solid piece.
Figure 2A:
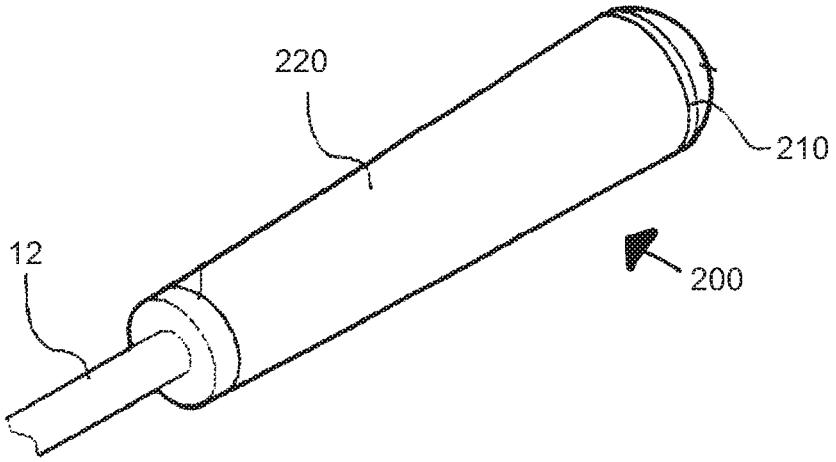
Figure 2a (Prior Art)
FIG. 2*a* is a perspective view of a prior art grip having a hollow cylinder and an overlapping cushioning layer.
Figure 2B:
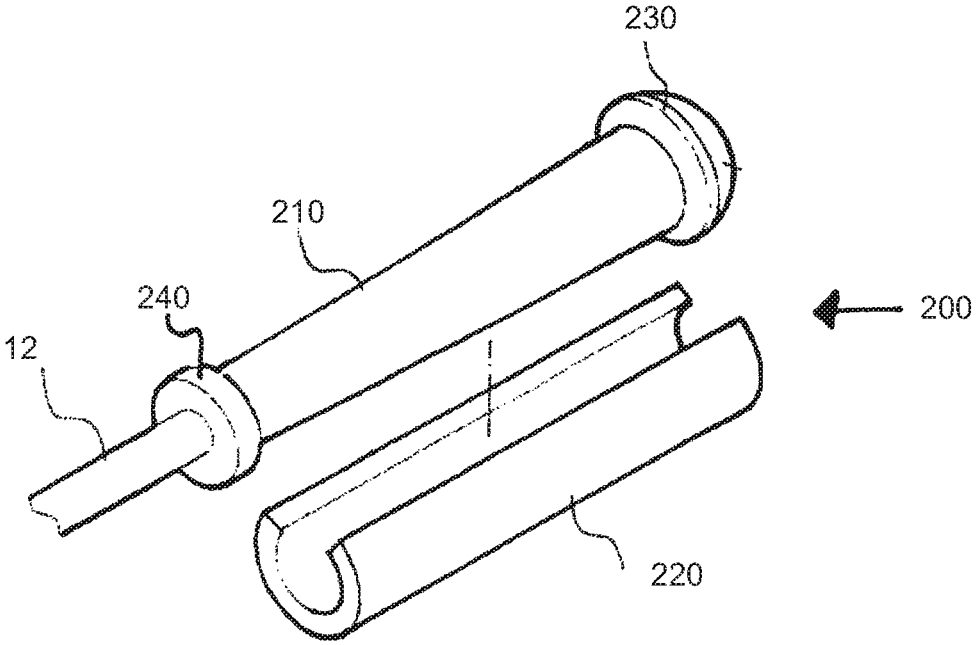
Figure 2b (Prior Art)
FIG. 2*b* shows an exploded view of the prior art grip of FIG. 2*a* having a hollow cylinder and an overlapping cushioning layer.
Figure 3:
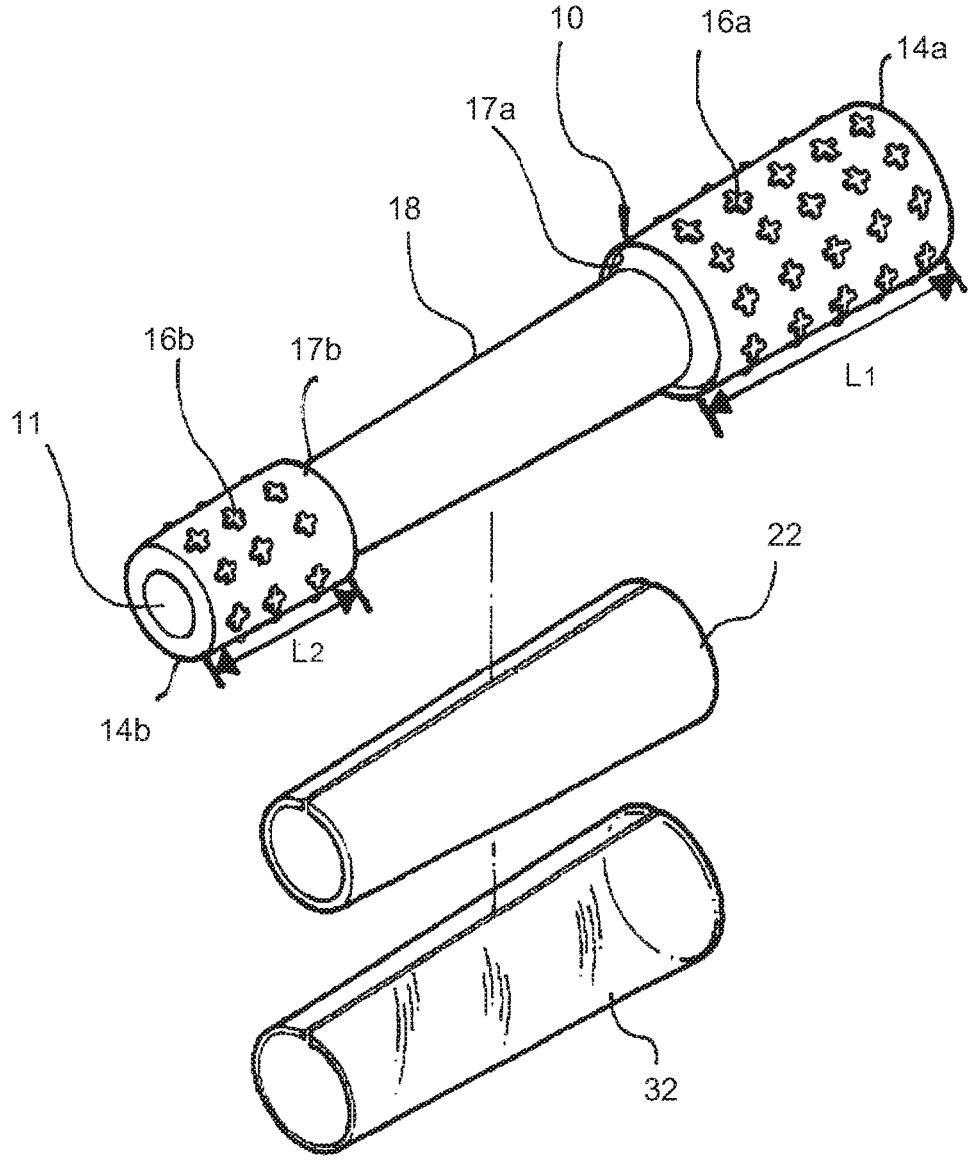
FIG. 3 is an exploded view of an embodiment of the grip of the present invention, having grip end portions, a center portion, and layers, including a cushioning layer and a transparent layer, for overlaying the center portion.
Figure 6:
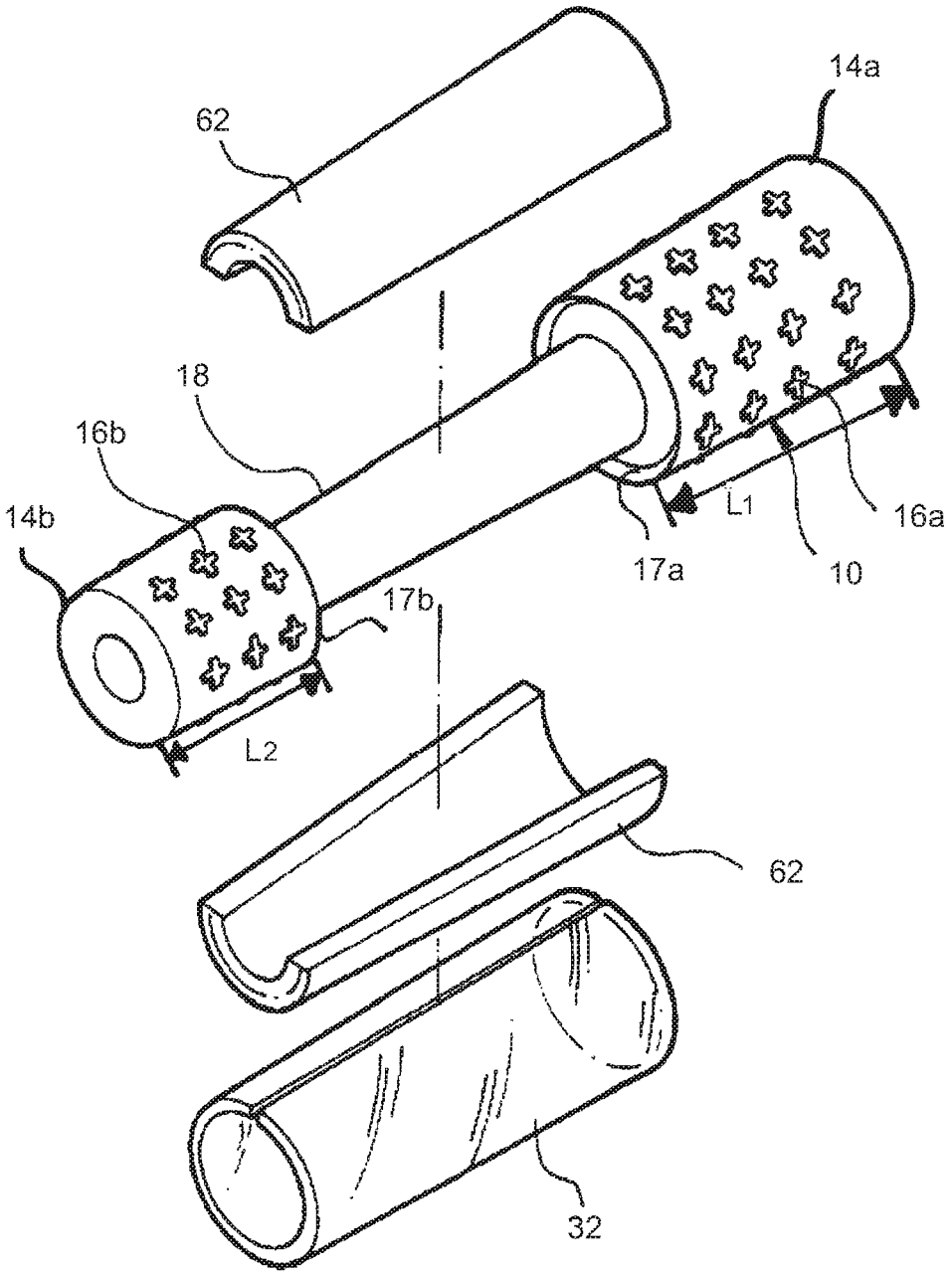
FIG. 6 is an exploded view of another embodiment of the grip of the present invention, having grip end portions, a center portion, and layers, including a lightweight layer and a transparent layer, for overlaying the center portion.

As illustrated in FIGS. 3 and 6, the grip 10 comprises grip ends 14*a* and 14*b*, grip end portions 16*a* and 16*b*, and a center portion 18. The grip end portions 16*a* and 16*b* extend by lengths L1 and L2, respectively, from the grip ends 14*a* and 14*b*, respectively. The grip end portions 16*a* and 16*b* may be fabricated of a durable material for protecting the grip ends 14*a* and 14*b* from damage.

Figure 4:
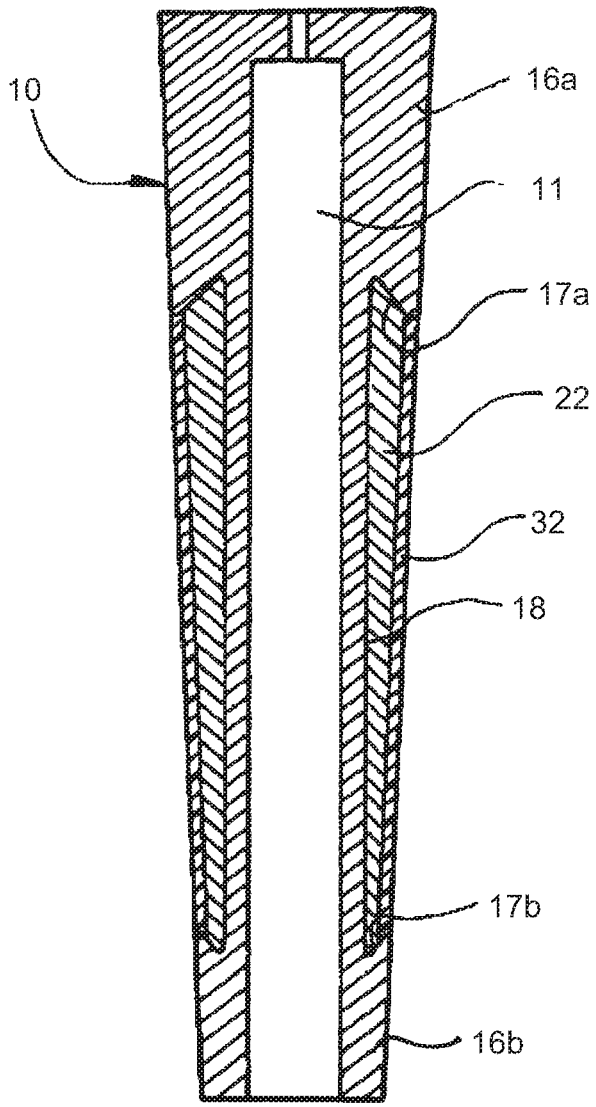
FIG. 4 shows a side cross-sectional view of the grip of FIG. 3.
Figure 5:
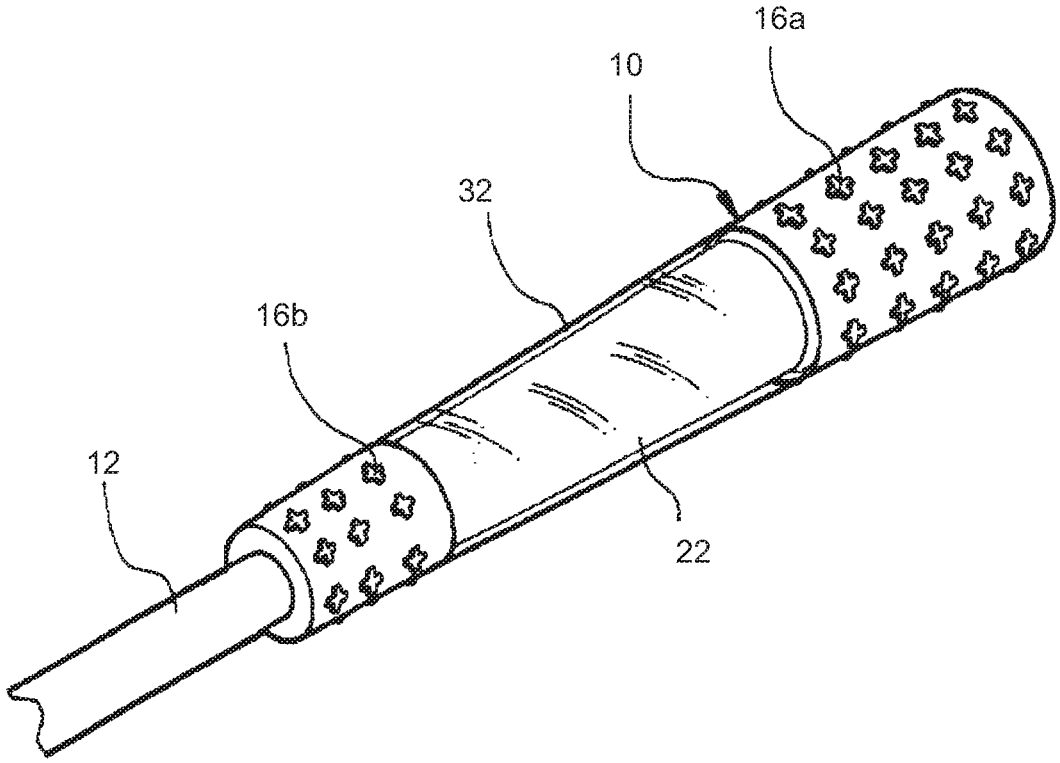
FIG. 5 shows a perspective view of the grip of FIGS. 3 and 4 installed on a gripping end of sporting equipment.
Figure 7:
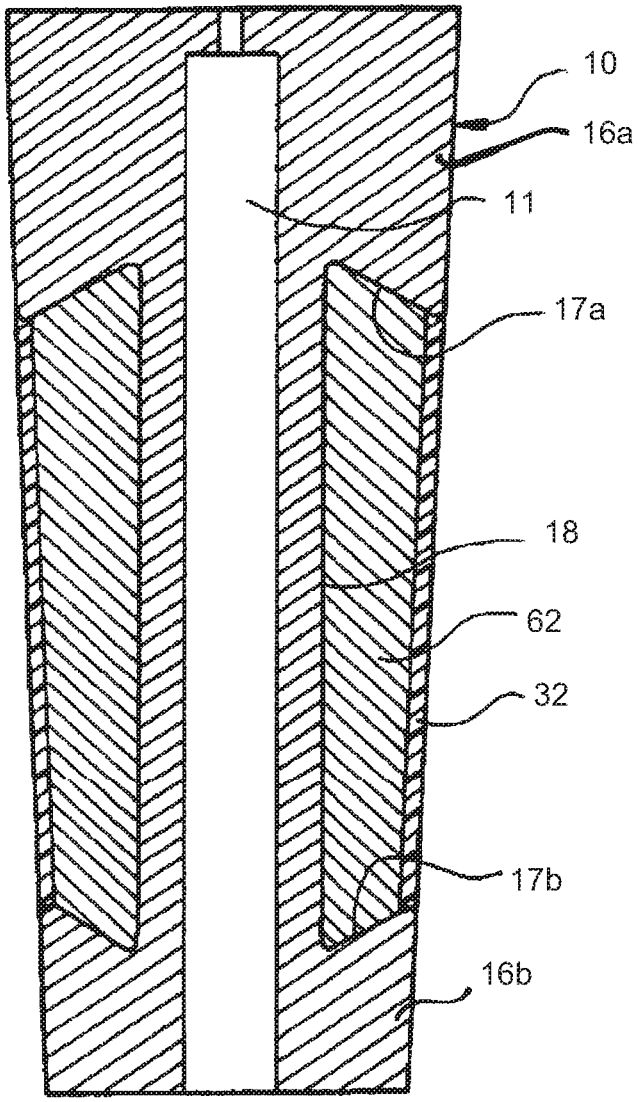
FIG. 7 shows a side cross-sectional view of the grip of FIG. 6.
Figure 8:
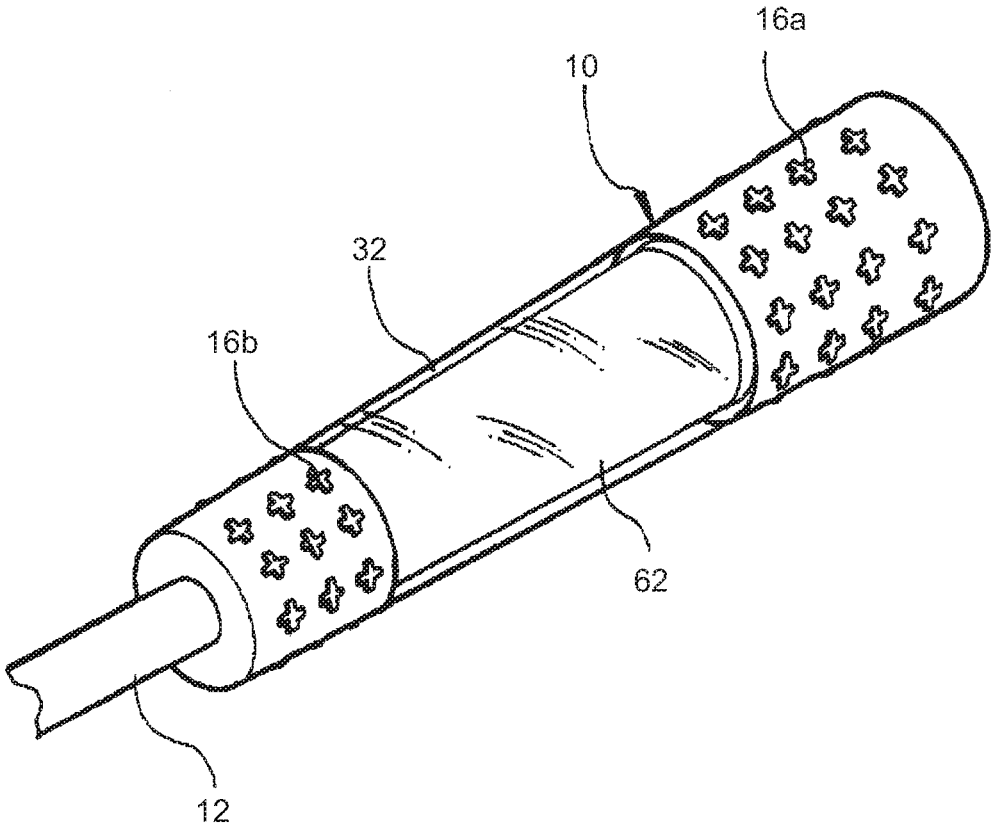
FIG. 8 shows a perspective view of the grip of FIGS. 6 and 7 installed on a gripping end of sporting equipment.

The center portion 18, which may take the form of a hollow cylinder, is located between the grip end portions 16*a* and 16*b*. The center portion is adapted for receiving the gripping end 12 in an interior thereof, as shown in FIGS. 5 and 8. The grip end portions 16*a* and 16*b* are also adapted for receiving the gripping end 12 in an interior 11 thereof. Turning to FIGS. 4 and 7, the grip end portions 16*a* and 16*b* define receivers 17*a* and 17*b*, respectively. In combination, the center portion 18 and the receivers 17*a* and 17*b* define a holder 21 for one or more layers to form a central area of the grip 10. As can be seen from the drawing figures (see especially FIGS. 4, 7, 9, and 10A-10D, holder 21 defines a depth D that is greater than a thickness T of side wall 19. This configuration of holder 21 allows insertion, application, or overlaying of layers of material as will be described below, without substantially increasing a weight of the finished grip 10.

The receivers 17*a* and 17*b* may be adapted to receive a first layer, such as a layer 22 or 62, disposed over the center portion and within holder 21. In this manner, the receivers 17*a* and 17*b* assist in protecting opposed ends of the first layer from damage. The receivers 17*a* and 17*b* may take any form suitable to receive the first layer. Exemplary forms of the receivers 17*a* and 17*b* include, without limitation, a flange, rim, projecting edge, lip, slant, groove, bevel, channel, slot, slit, or notch. Non-limiting examples of embodiments of receivers 17*a* and 17*b* are shown in FIGS. 10A -10D. The first layer may also take any of a variety of forms, such as a hollow cylinder, a planar sheet having two side edges, a top edge, and a bottom edge, or the like. A second layer, such as a layer 32, may also be disposed over the first layer, and the receivers 17*a* and 17*b* may be adapted also to receive the second layer. Accordingly, the receivers 17*a* and 17*b* may also assist in protecting opposed ends of the second layer from damage.

Figure 9:
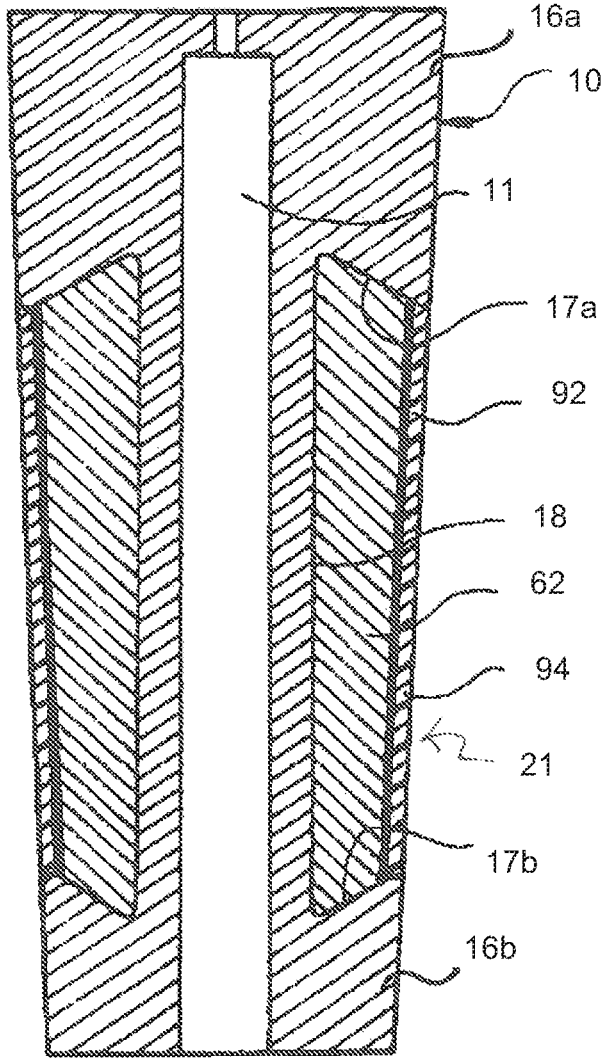
FIG. 9 is a side cross-sectional view of another embodiment of the grip of the present invention, having grip end portions, a center portion, and layers, including a lightweight layer, a cushioning layer, and a transparent layer, for overlaying the center portion.
Figure 10A:
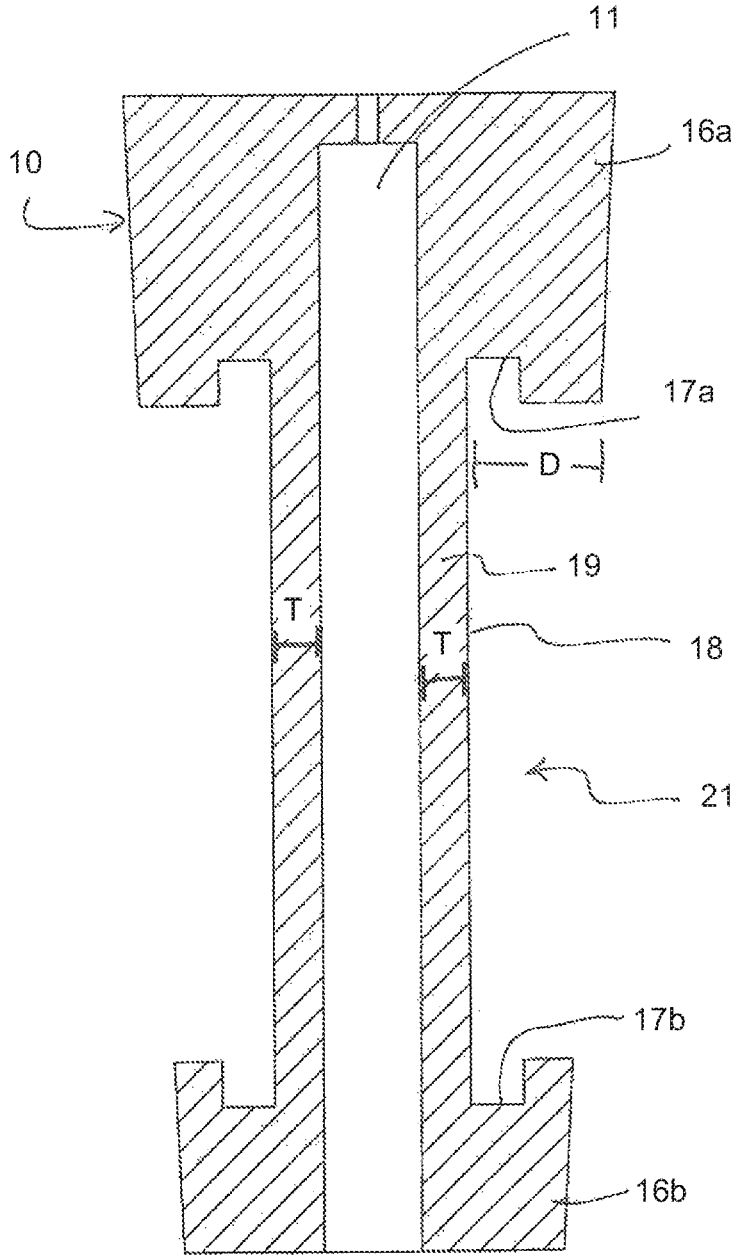
FIGS. 10A-10D show different embodiments of the center portion of the grip of FIG. 4.
Figure 10B:
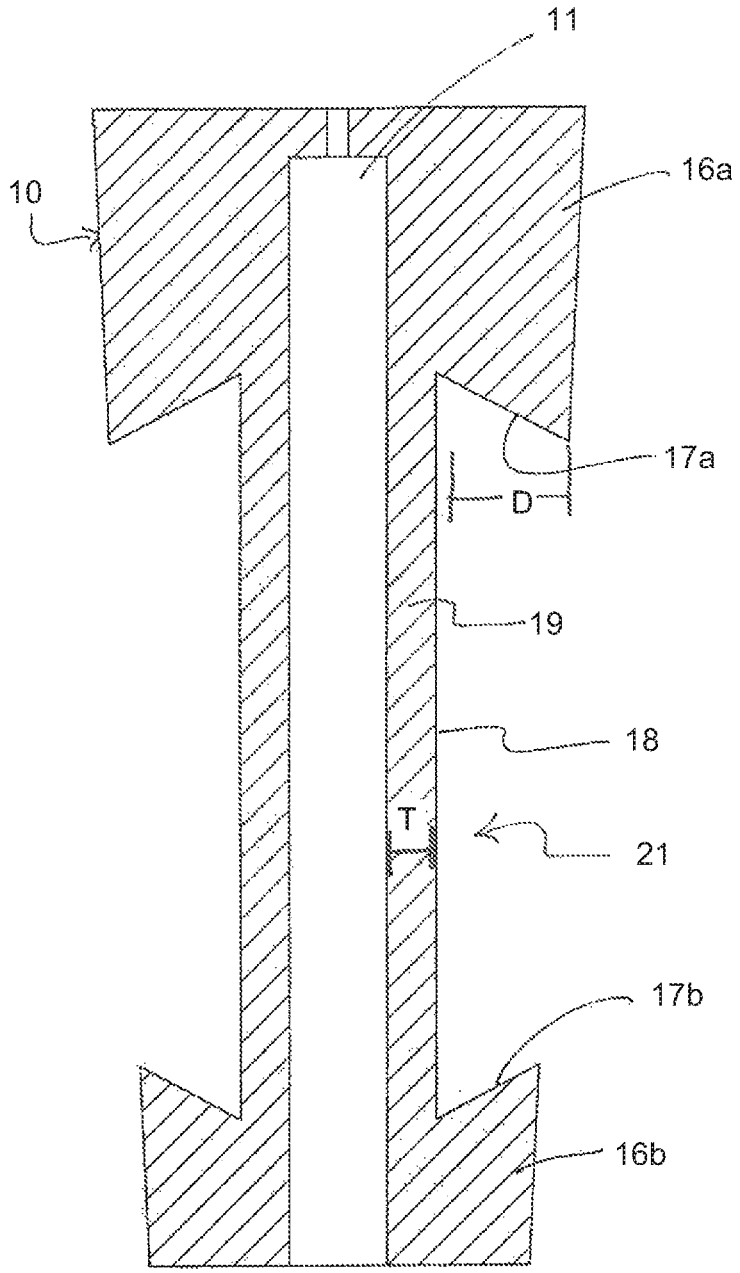
Figure 10C:
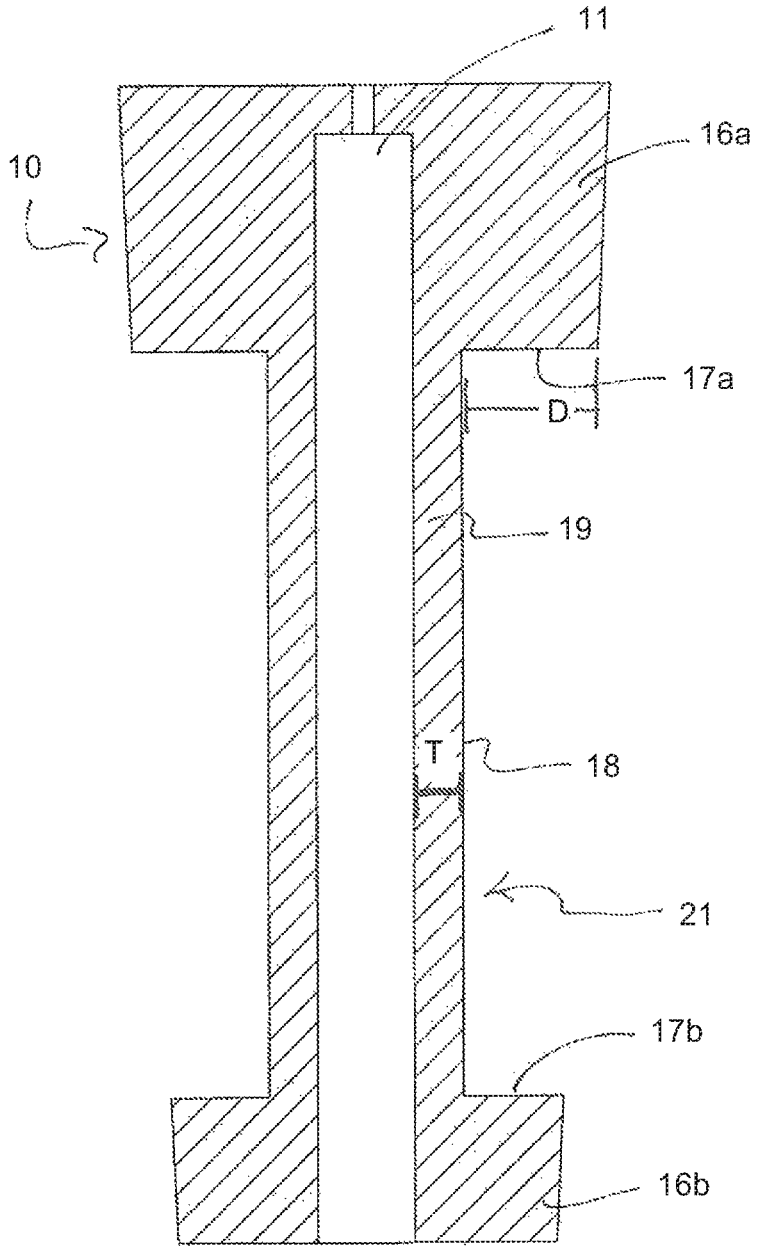
Figure 10D:
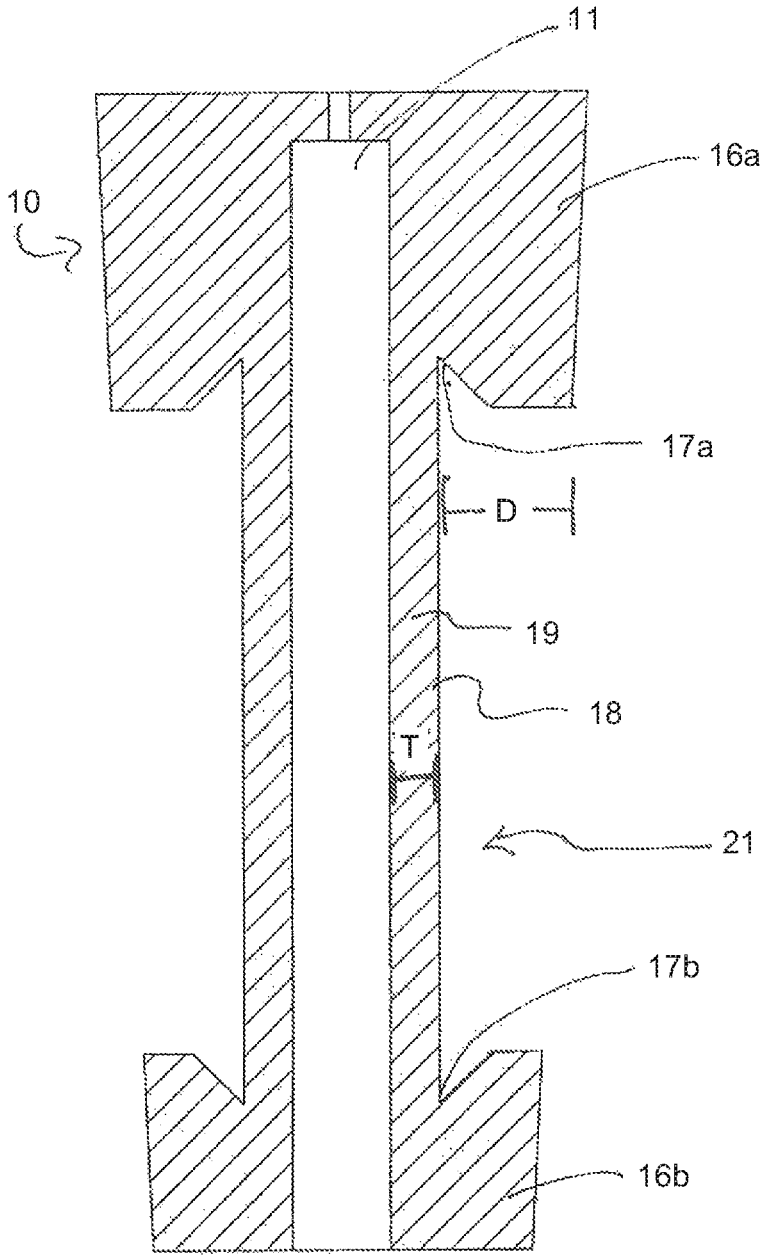

As illustrated in FIG. 9, a third layer, such as a layer 94, may be disposed over the second layer, such as a layer 92, and the second layer may be disposed over the first layer, such as a layer 62. The receivers 17*a* and 17*b* may be adapted also to receive the third layer. It will be appreciated that multiple additional layers could be disposed over first, second, and third layers, in accordance with the needs of the user, i.e. in accordance with the desired properties of cushioning, aesthetics, thickness, durability, tackiness, etc.

Returning to FIG. 3, it will also be appreciated that the grip end portions 16*a* and 16*b* may be attached to the center portion 18 using any method of attachment known in the art. For example, a combination of adhesive and friction fit may be used to attach the grip end portions 16*a* and 16*b* to the center portion 18. Alternatively, only a friction fit or only an adhesive may be desirable. In still other embodiments, snap fit structures may be used for attaching the grip end portions 16*a* and 16*b* to the center portion 18. Even further, the grip end portions 16*a* and 16*b* and the center portion 18 may be formed or molded as a single unit using any method of formation or molding known in the art. For example, injection molding, compression molding, extrusion molding, casting, and the like may be used to form the grip end portions 16*a* and 16*b* and the center portion 18 as a single unit.

Also, a suitable adhesive may be coated onto an outer surface of the center portion 18 to affix the first layer, such as the layer 22, to the center portion 18. Alternatively, the adhesive may be coated onto an inner surface of the first layer, or onto both surfaces. Still further, the center portion or the first layer may be pre-coated with the adhesive during manufacture. Numerous suitable adhesive substances are known in the art. In other embodiments, the center portion and the first layer may be manufactured of compatible materials such that heat and pressure bond them together. The first layer may then be placed over or wrapped around the center portion 18 and received in the receivers 17*a* and 17*b*. In this manner, the receivers 17*a* and 17*b* may assist in preventing the leakage of adhesive from an area between the first layer and the center portion 18.

A suitable adhesive may also be coated onto an outer surface of the first layer, such as the layer 22, onto an inner surface of the second layer, such as the layer 32, or onto both surfaces to affix the surfaces together. Alternatively, the first layer or the second layer may be pre-coated with the adhesive during manufacture. Again, numerous suitable adhesive substances are known in the art. In yet another embodiment, the layers may be manufactured of compatible materials such that heat and pressure bond them together. The second layer may then be placed over the first layer and received in the receivers 17*a* and 17*b*. In this regard, the receivers 17*a* and 17*b* may also assist in preventing the leakage of adhesive from an area between the second layer and the first layer.

Turning to FIG. 9, a suitable adhesive may be also used to connect the second layer, such as the layer 92, and the third layer, such as the layer 94, as well as any subsequent layers. In turn, the third layer and any subsequent layers, may then be received in the receivers 17*a* and 17*b*, and the receivers 17*a* and 17*b* may also assist in preventing the leakage of adhesive from areas between these layers.

Returning to FIG. 3, the lengths L1 and L2 of the grip end portions 16*a* and 16*b* may be varied to any length having the desired property of protecting the grip ends from damage. In particular embodiments, the grip end portions 16*a* and 16*b* may be manufactured to extend along a length of from about 1 millimeter to about 98 millimeters along the gripping end 12 (shown in FIG. 5). In other embodiments, the grip end portions may be manufactured to extend along a length of about 0.15 inches along the gripping end. It will be appreciated that the grip end portions may also extend various other lengths along the gripping end.

Any material having one or more desired properties of durability, thickness, strength, cushioning, tackiness, and aesthetically pleasing appearance may be used in fabricating the grip end portions 16*a* and 16*b* and the receivers 17*a* and 17*b*, such as rubber, polymers, latex, natural or synthetic leather, closed cell foams, open cell foams, natural material, synthetic material, or any other material currently used in fabricating grips for sports equipment. In addition, an elongated strip with a locking mechanism as is described in the present inventor's U.S. Pat. No. 6,971,959 for a Grip for Sports Equipment, the entirety of which is incorporated herein by reference, may be used to form the grip end portions. The thickness of the grip end portions may be varied in accordance with the needs of the user, i.e. in accordance with the preferred grip thickness.

Any material having one or more desired properties of durability, thickness, strength, cushioning, tackiness, and shock absorption required for underlying the layers may be used in fabricating the center portion 18, such as polymers, rubber, latex, natural or synthetic leather, natural material, synthetic material, or any other material currently used in fabricating grips for sports equipment. The thickness of the center portion may also be varied in accordance with the needs of the user, i.e. in accordance with the user's hand size and preferred grip thickness.

Also, any material having the desired properties of cushioning, tackiness, aesthetics, durability, thickness, strength, and aesthetically pleasing appearance required for a slip-resistant grip may be used in fabricating any of the layers, such as polymers (for example polystyrene or polyurethane), closed cell foams, open cell foams, latex, rubber, natural or synthetic leather, natural material, synthetic material, or any other material currently used in fabricating grips for sports equipment. The thickness of any of the layers may be varied in accordance with the needs of the user, i.e. in accordance with the user's hand size and preferred grip thickness.

In addition, any of the layers may be fabricated of any suitable lightweight material, such as closed cell foams, open cell foams, polymers (for example polystyrene or polyurethane), or synthetic foams. As illustrated in FIGS. 6-9, the thickness of the layers, such as the layer 62, formed of such a lightweight material may be increased without greatly increasing the weight of the grip, thereby increasing the size of the grip without greatly increasing the weight of the grip. In this manner, a reduced weight oversized grip may be formed. Such a reduced weight oversized grip may be desirable for various reasons, such as accommodating the user's hand size and preventing the overlapping of the user's hands without increasing the grip weight to a weight that inhibits the user's performance in the sport of choice.

Any of the layers also may be fabricated of a suitable substantially transparent material and may protect a design placed on the grip while still allowing visualization of the design. Such a system is described in the present inventor's U.S. Pat. No. 6,718,675 for a Display Grip for Sports Equipment, the entirety of which is incorporated herein by reference.

Accordingly, the grip of the present invention provides several advantages over conventional grips. For example, because the receivers 17*a* and 17*b* of the grip receive the layers, the incidence of leakage of the adhesive from the inner surfaces of the layers of the grip is reduced. In this manner, staining and damaging of the layers from leaking adhesive is also reduced, and the grip's ability to provide a cushioned, reduced slippage surface without damage from leaking adhesive is enhanced. Also, the reduction of leaking adhesive lessens damage to information and decorative designs displayed on the grip.

In addition, the grip of the present invention includes grip end portions, which reduce damage to the grip from contact with other grips. Also, any of the layers of the grip of the present invention may be fabricated of any suitable lightweight material, allowing the size of the grip to be increased without greatly increasing the weight of the grip. At the same time, the grip of the present invention does not compromise the desirable properties of the grip or prevent the display of information on the gripping area.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, an end cap may overlay an end of the grip end portion 16*a* on the distal portion of gripping end 12, either before or after the grip 10 of the present invention is installed thereon, using a combination of adhesive and a friction fit as is known in the art. A rib and groove structure as is described in the present inventor's U.S. Pat. No. 6,718,675 for a Display Grip for Sports Equipment may also be used to secure the grip end portion 16*a* to the end cap.

The embodiment described was chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. A grip for sporting equipment having a gripping end, comprising:

a pair of grip ends;

each of said pair of grip ends defining a grip end portion terminating in a flange and extending distally from about 25 to about 98 mm from a terminus of each of the said pair of grip ends; and a center portion separate from the pair of grip ends, comprising at least one side wall and adapted to receive the gripping end in an interior thereof;

wherein the pair of grip ends are disposed on opposed ends of the center portion and each grip end portion flange defines a receiver adapted for receiving and overlapping an edge of one or more layers substantially overlaying the center portion;

further wherein the center portion and grip end portion receivers together define a holder having a depth that is greater than a thickness of the center portion at least one side wall, said depth remaining greater than said thickness along an entire length dimension of the center portion between the grip end portions.

2. The grip of claim 1, wherein the grip end portion comprises a durable material for protecting the grip end from damage.

3. The grip of claim 1, wherein the grip end portion comprises a material selected from the group consisting of rubber, polymers, latex, natural leather, and synthetic leather.

4. The grip of claim 1, wherein the center portion defines a hollow cylinder for receiving the gripping end.

5. The grip of claim 1, wherein at least one of the one or more layers comprises a cushioning material.

6. The grip of claim 1, wherein at least one of the one or more layers comprises a material selected from the group consisting of polystyrene, polyurethane, closed cell foams, open cell foams, latex, rubber, natural leather, and synthetic leather.

7. The grip of claim 1, wherein at least one of the one or more layers comprises a lightweight material.

8. The grip of claim 1, wherein at least one of the one or more layers comprises a material selected from the group consisting of polystyrene, closed cell foams, and open cell foams.

9. The grip of claim 1, wherein at least one of the one or more layers comprises a substantially planar sheet having two side edges, a top edge, and a bottom edge.

10. The grip of claim 1, wherein the receiver defines a slot.

11. The grip of claim 1, wherein at least one of the one or more layers comprises a substantially transparent layer.

12. The grip of claim 1, further comprising an end cap.

13. The grip of claim 1, wherein the grip end portion is adapted to receive the gripping end.

14. A unitary grip for sporting equipment having a gripping end, comprising:

a center portion comprising at least one side wall, adapted to receive the gripping end; and a pair of grip ends each defining grip end portions disposed on opposed ends of the center portion, each of the grip end portions terminating in a flange and having a length of from about 25 mm to about 98 mm to define a receiver to receive and overlap an edge of one or more layers substantially overlaying the center portion;

wherein the center portion and pair of grip end portion receivers define a holder having a depth that is greater than a thickness of the center portion at least one side wall, said depth remaining greater than said thickness along an entire length dimension of the center portion between the grip end portions.

15. The grip of claim 14, wherein the grip end portion comprises a durable material for protecting the one or more layers from damage.

16. The grip of claim 14, further comprising an end cap.

17. The grip of claim 14, wherein the grip end portion is adapted to receive the gripping end.

18. A grip for sporting equipment having a gripping end, comprising:

a pair of grip ends;

a grip end portion flange extending from each of the pair of grip ends, said grip end and flange extending at least from about 25 mm to 98 mm from said grip end portion; and a center portion comprising at least one side wall, adapted to receive the gripping end in an interior thereof;

wherein the pair of grip ends are disposed on opposed ends of the center portion and each grip end portion flange defines defining a receiver adapted for receiving and overlapping an edge of one or more layers substantially overlaying the center portion.

19. The grip of claim 18, wherein said pair of grip ends, grip end portion flanges, and center portion are a unitary construct.

* * * * *